US009449728B2

(12) United States Patent
Tsuru

(10) Patent No.: US 9,449,728 B2
(45) Date of Patent: Sep. 20, 2016

(54) ELECTROCONDUCTIVE MATERIAL FOR CONNECTION COMPONENT

(71) Applicant: KOBE STEEL, LTD., Kobe-shi (JP)

(72) Inventor: Masahiro Tsuru, Shimonoseki (JP)

(73) Assignee: KOBE STEEL, LTD., Kobe-shi (JP)

( * ) Notice: Subject to any disclaimer, the term of this patent is extended or adjusted under 35 U.S.C. 154(b) by 249 days.

(21) Appl. No.: 13/790,680

(22) Filed: Mar. 8, 2013

(65) Prior Publication Data

US 2013/0260174 A1 Oct. 3, 2013

(30) Foreign Application Priority Data

Mar. 30, 2012 (JP) ..... 2012-078748

(51) Int. Cl.

| | |
|---|---|
| ***H01B 1/02*** | (2006.01) |
| ***C25D 5/10*** | (2006.01) |
| ***C25D 5/12*** | (2006.01) |
| ***C25D 5/50*** | (2006.01) |

(52) U.S. Cl.

CPC ..... *H01B 1/026* (2013.01); *C25D 5/10* (2013.01); *C25D 5/12* (2013.01); *C25D 5/505* (2013.01); *Y10T 428/1291* (2015.01); *Y10T 428/12708* (2015.01); *Y10T 428/12715* (2015.01)

(58) Field of Classification Search

None

See application file for complete search history.

(56) References Cited

U.S. PATENT DOCUMENTS

| | | | |
|---|---|---|---|
| 2003/0129441 | A1 | 7/2003 | Hara et al. |
| 2004/0209112 | A1 | 10/2004 | Hara et al. |
| 2008/0090096 | A1 | 4/2008 | Suzuki et al. |
| 2010/0304016 | A1 | 12/2010 | Suzuki et al. |

FOREIGN PATENT DOCUMENTS

| | | | |
|---|---|---|---|
| CN | 1985333 | A | 6/2007 |
| EP | 1 788 585 | A1 | 5/2007 |
| EP | 2 369 688 | A1 | 9/2011 |
| JP | 2006-77307 | | 3/2006 |
| JP | 2006-183068 | | 7/2006 |
| JP | 4024244 | | 10/2007 |
| JP | 4090302 | | 3/2008 |
| JP | 4771970 | | 7/2011 |
| WO | WO 2009/123144 | A1 | 10/2009 |

OTHER PUBLICATIONS

English Machine Translation of JP2006183068A, printed Sep. 3, 2013.*

(Continued)

*Primary Examiner* — Adam Krupicka

(74) *Attorney, Agent, or Firm* — Oblon, McClelland, Maier & Neustadt, L.L.P.

(57) ABSTRACT

An electroconductive material for a connection component have a base member made of a copper alloy plate, a Ni coating layer, a Cu—Sn alloy coating layer, and a Sn coating layer. A surface of the material is subjected to reflow treatment. The base member surface is roughened. The Cu—Sn alloy coating layer is partially exposed from the outside surface of the Sn coating layer. Regions of the Cu—Sn alloy coating layer exposed to the outside surface of the Sn coating layer have random microstructures distributed irregularly between portions of the Sn coating layer and streak microstructures extending in parallel to a rolled direction of the base member. The streak microstructures having a length of 50 μm or more and a width of 10 μm or less are contained in a number of 35 or more per 1 $mm^2$.

8 Claims, 2 Drawing Sheets

(56) References Cited

OTHER PUBLICATIONS

U.S. Appl. No. 13/785,549, filed Mar. 5, 2013, Tsuru, et al.

The Extended European Search Report issued Aug. 20, 2013, in Application No. / Pat. No. 13001299.0-1360.

* cited by examiner

ELECTROCONDUCTIVE MATERIAL FOR CONNECTION COMPONENT

This application claims priority from Japanese Patent Application No. 2012-078748, the disclosure of which is incorporated herein by reference in its entirety.

BACKGROUND OF THE INVENTION

The present invention relates to an electroconductive material for a connection component, such as a terminal, mainly used in the field of automobiles and general consumer product fields, and particularly to a Sn-plated electroconductive material for a connection component capable of attaining, in particular, decreasing of friction between a male terminal and a female terminal when they are fitted to or separated from each other as well as decreasing fretting corrosion during use.

DESCRIPTION OF RELATED ART

In the field of automobile electric equipment, multi-terminalization of connecters has been progressed due to advancement and wide use of electronic control. Fore for inserting the connectors is increased and bodily burden onto workers in the step of assembling automobiles is increased. Thus, the connector inserting force has been desired to be decreased.

It is necessary to decrease force for inserting individual Sn-plated terminals constituting a connector in order to decrease the connector inserting force. Until now, the followings are suggested: (1) an Sn-plated electroconductive material for a connection component having a copper alloy base member and having, over a surface thereof, a surface coating layer composed of a Ni underlying layer, a Cu—Sn alloy coating layer and a Sn coating layer (see Japanese Patent No. 4090302), and (2) a Sn-plated electroconductive material for a connection component having a copper alloy base member with fine asperities and having, over a surface thereof, a surface coating layer composed of a Ni underlying layer, a Cu—Sn alloy coating layer and a Sn coating layer, in which the Cu—Sn alloy coating layer is partially exposed from the outermost surface (see Japanese Patent No. 4024244 and Japanese Patent No. 4771970). In the field of automobiles and others, an actual use of these materials has been increasing. Japanese Patent Nos 4090302, 402444, 4771970 are incorporated by reference.

In the Sn-plated electroconductive material for a connection component in the item (1), the Cu—Sn alloy coating layer, which is a hard layer, is formed below the Sn coating layer; thus, the frictional coefficient of the material can be decreased by about 30% from that of a precedent Sn-plated electroconductive material for a connection component. In the Sn-plated electroconductive material for a connection component in the item (2), the hard Cu—Sn alloy coating layer exposed from the outermost surface receives a load, so that frictional coefficient of the material can be largely decreased.

The use of the Sn-plated electroconductive material for a connection component as a terminal material can decrease the connector inserting force. However, because further progressing of the multi-terminalization is expected hereinafter, such frictional coefficient of electroconductive materials has been desired to be decreased.

On the other hand, for decreasing the connector inserting force, it is effective to lower its terminals in contacting pressure. However, if the contacting pressure is lowered, fretting corrosion is generated between male and female terminals due to vibration of an engine of the automobile and the vibration while the automobile is moving. Thus, Sn plating on surfaces of the terminals is abraded. An corrosion powder generated by the corrosion invades the contact point regions to oxidize the regions, thus increasing the regions in contact resistance and generated heat. In order to prevent this fretting corrosion phenomenon, it is effective to increase the contacting pressure to some degree. However, because the increased contacting pressure also increases the inserting force, the increased in the contacting pressure is restricted.

SUMMARY OF THE INVENTION

In light of such problems in the conventional art, the present invention has been made. An object thereof is to provide an electroconductive material for a connection component lower in frictional coefficient and excellent in fretting corrosion resistance than conventional electroconductive materials for a connection component (see the items (1) and (2)).

The present invention is an invention obtained by developing the electroconductive material for a connection component described in Japanese Patent Nos. 4024244 and 4771970. Specifically, the present invention provides an electroconductive material for a connection component, comprising a base member made of a copper alloy plate, a Cu—Sn alloy coating layer formed on the base member and having a Cu content of 20 to 70% by atom and an average thickness of 0.2 to 3.0 μm, and a Sn coating layer formed on the Cu—Sn alloy coating layer having an average thickness of 0.2 to 5.0 μm, wherein a surface of the material is subjected to reflow treatment and has an arithmetic average roughness Ra of 0.15 μm or more in one or more direction(s) along the surface and an arithmetic average roughness Ra of 3.0 μm or less in all directions along the surface, wherein the Cu—Sn alloy coating layer is formed to so as to be partially exposed from the outside surface of the Sn coating layer, the area ratio of the exposed surface of the Cu—Sn alloy coating layer to the material surface being 3 to 75%, and the Cu—Sn alloy coating layer having an average material surface exposed region interval of 0.01 to 0.5 mm in one or more direction(s) along the surface, characterized in that regions of the Cu—Sn alloy coating layer exposed from the outside surface of the Sn coating layer have random microstructures distributed irregularly between portions of the Sn coating layer and streak microstructures extending in parallel to a rolled direction of the base member; and in that the streak microstructures having a length of 50 μm or more and a width of 10 μm or less are contained in a number of 35 or more per 1 $mm^2$. In this electroconductive material for a connection component, a frictional coefficient in the direction perpendicular to the rolled direction is smaller than that in the direction parallel thereto.

In the electroconductive material for a connection component, it is desired that the thickness of the regions of the Cu—Sn alloy coating layer exposed from the outside surface of the Sn coating layer is 0.2 μm or more.

The electroconductive material for a connection component may further comprises a Cu coating layer between the surface of the base member and the Cu—Sn alloy coating layer.

The electroconductive material may further comprises a Ni coating layer may between the surface of the base member and the Cu—Sn alloy coating layer. In this case, the material may further have a Cu coating layer between the Ni coating layer and the Cu—Sn alloy coating layer.

Furthermore, it is desired that the surface of the base member has an arithmetic average roughness Ra of 0.3 μm or more in one or more direction(s) along the surface, and an arithmetic average roughness Ra of 4.0 μm or less in all directions along the surface. It is also desired that in the base member surface, its asperities have an average interval Sm of 0.01 to 0.5 mm in one or more direction(s) along the surface.

In the present invention, the Sn coating layer, the Cu coating layer and the Ni coating layer are not only metallic Sn, Cu and Ni, respectively, but also may be a Sn alloy, a Cu alloy and a Ni alloy, respectively.

In the electroconductive material for a connection component, the regions of the Cu—Sn alloy coating layer exposed from the outside surface of the Sn coating layer contain the random microstructures distributed irregularly between the portions of the Sn coating layer, and further contain specifically-formed streak microstructures extending in parallel to the rolled direction in a prescribed density or more, so that frictional coefficient of the material is made lower, in particular in the direction perpendicular to the rolled direction than conventional electroconductive materials for a connection component. By punching out the electroconductive material for a connection component (copper alloy plate) into a connection component, such as a fittable type terminal, to make the inserting direction thereof perpendicular to the rolled direction, force for inserting the connection component can be decreased. The electroconductive material for a connection component is also excellent in fretting corrosion resistance in the same direction.

DETAILED DESCRIPTION OF THE INVENTION

Figure 1:
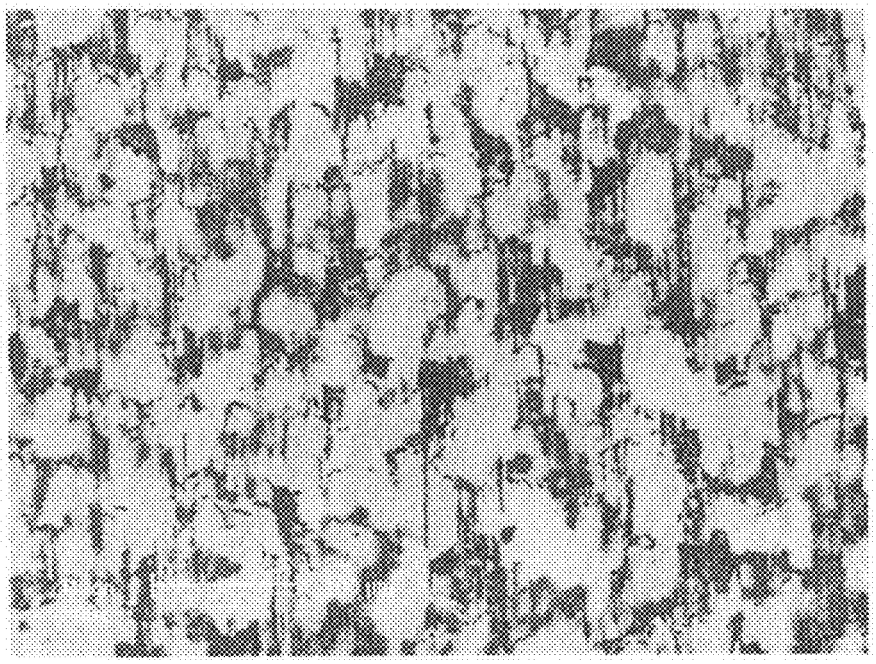
FIG. 1 is a scanning electron microscopic compositional image of an outmost surface structure of a test material of Example No. 3.

An electroconductive material for a connection component according to the present invention comprises a base material, a Cu—Sn alloy coating layer formed on the base material, and an Sn coating layer formed on the Cu—Sn alloy coating layer. A material surface of the electroconductive material is subjected to reflow treatment. As described later in detail, other one or more coating layer(s) can be interposed between the base material and the Cu—Sn alloy layer. In the electroconductive material for a connection component according to the present invention, definitions of the followings are the same as in Japanese Patent No. 4024244: the Cu content in its Cu—Sn alloy coating layer; the average thickness of the Cu—Sn alloy coating layer; the average thickness of its Sn coating layer; the arithmetic average roughness Ra of a surface of the material over which the coating layer is formed; the area ratio of the exposed surface of the Cu—Sn alloy coating layer to the material surface; the exposed interval of regions of the Cu—Sn alloy coating layer that are exposed from the material surface; the thickness of regions of the Cu—Sn alloy coating layer that are exposed from the outside surface of the Sn coating layer; the average thickness of its Cu coating layer; the average thickness of its Ni coating layer; the arithmetic average roughness of the base member surface; and the average interval Sm between asperities in the base member surface. Hereinafter, these definitions are initially described to confirm the definitions, and then a specific description is made about a characteristic of the electroconductive material for a connection component according to the present invention, that is, the form of the regions of the Cu—Sn alloy coating layer exposed from the outside surface of the Sn coating layer.

(1) Cu Content in Cu—Sn Alloy Coating Layer

The Cu—Sn alloy coating layer having a Cu content of 20 to 70% by atom is made of an intermetallic compound made mainly of a $Cu_6Sn_5$ phase. The $Cu_6Sn_5$ phase is far harder than Sn or Sn alloy, which constitutes the Sn coating layer. A partial exposure/formation of this phase onto the outermost layer of the material makes the following possible: when the terminals are fitted to each other or separated from each other, deformation resistance based on the dipping up of the Sn coating layer is restrained, as well as shear resistance of shearing the cohesion is restrained. As a result, the terminals can be made very low in frictional resistance. Furthermore, in the present invention, the $Cu_6Sn_5$ phase partially projects from the outside surface of the Sn coating layer. Thus, when the electric contact point regions slide or slide minutely in the terminal fitting or separation, under any vibration environment or the like, the hard $Cu_6Sn_5$ phase receives contacting pressure so that the contacting area between their Sn coating layers can be remarkably reduced. Thus, frictional coefficient of the terminals can be made even lower to reduce the wear or oxidization of the Sn coating layer, which is caused by the fretting corrosion. On the other hand, although a $Cu_3Sn$ phase is harder, the Cu content therein is larger than that in the $Cu_6Sn_5$ phase. Accordingly, when this $Cu_3Sn$ phase is partially exposed from the outside surface of the Sn coating layer, the amount of a Cu oxide and others is increased on the material surface, for example, with the passage of time or by corrosion. Thus, each of the terminals is easily increased in contact resistance, and does not easily keep electrical connecting reliability. Additionally, the $Cu_3Sn$ phase is more brittle than the $Cu_6Sn_5$ phase, therefore inducing poor shaping processability. Accordingly, constituent components of the Cu—Sn alloy coating layer are regulated to set the Cu content into the range of 20 to 70% by atom. This Cu—Sn alloy coating layer may partially contain a $Cu_3Sn$ phase, and may contain, for example, component elements in the underlying plating layer, the base member, and the Sn plating. However, if the Cu content in the Cu—Sn alloy coating layer is less than 20% by atom, the cohesive force is increased so that frictional coefficient of the terminal is not easily made low. Furthermore, the terminal is also declined in fretting corrosion resistance. On the other hand, if the Cu content is more than 70% by atom, the terminal does not easily keep electrical connecting reliability based on the passage of time or corrosion. The material is also deteriorated in, for example, shaping processability. Accordingly, the Cu content in the Cu—Sn alloy coating layer is specified into the range of 20 to 70% by atom, more desirably 45 to 65% by atom.

(2) Average Thickness of Cu—Sn Alloy Coating Layer

In the present invention, the average thickness of the Cu—Sn alloy coating layer is defined as a value obtained by dividing the surface density (unit: $g/mm^2$) of Sn contained in the Cu—Sn alloy coating layer by the density (unit: $g/mm^3$) of Sn (a method for measuring the average thickness of a Cu—Sn alloy coating layer in an example described later is in accordance with this definition). If the average thickness of the Cu—Sn alloy coating layer is less than 0.2 μm, the following disadvantage is caused: in particular, when the Cu—Sn alloy coating layer is formed to be partially exposed from the material surface as in the present invention, the amount of a Cu oxide on the material surface is increased by thermal diffusion through, for example, high-temperature oxidization to increase the contact resistance easily. Thus, the terminal does not easily keep electrical connecting reliability. On the other hand, if the average thickness is more than 3.0 μm, an economical disadvantage is caused. The material is poor in productivity. The hard layer is formed to be large in thickness, so that the material is deteriorated in shaping processability, and others. Accordingly, the average thickness of the Cu—Sn alloy coating layer is specified to 0.2 to 3.0 μm, more desirably 0.3 to 1.0 μm.

(3) Average Thickness of Sn Coating Layer

In the present invention, the average thickness of the Sn coating layer is defined as a value obtained by dividing the surface density (unit: $g/mm^2$) of Sn contained in the Sn coating layer by the density (unit: $g/mm^3$) of Sn (a method for measuring the average thickness of a Sn coating layer in an example described later is in accordance with this definition). If the average thickness of the Sn coating layer is less than 0.2 μm, the amount of Cu diffused into the outside surface of the Sn coating layer by thermal diffusion becomes large so that the amount of a Cu oxide in the outside surface of the Sn coating layer becomes large, thus increasing the terminal easily in contact resistance, and deteriorating the terminal in corrosion resistance. It is therefore difficult that the terminal keeps electrical connecting reliability. On the other hand, if the average thickness is more than 5.0 μm, an economical disadvantage is caused. The material is also poor in productivity. Accordingly, the average thickness of the Sn coating layer is specified to 0.2 to 5.0 μm, more desirably 0.5 to 3.0 μm.

(4) Arithmetic Average Ra of Material Surface

If the arithmetic average Ra of the material surface is less than 0.15 μm in all directions along the surface, the height of projections of the Cu—Sn alloy coating layer from the material surface is low as a whole. When the electric contact point regions slide or slide minutely, the proportion of the receipt of the contacting pressure onto the hard $Cu_6Sn_5$ phase becomes small to make it difficult, in particular, to decrease the amount of the wear of Sn coating layer by the fretting corrosion. On the other hand, if the arithmetic average Ra is more than 3.0 μm in any of all the directions, the amount of a Cu oxide in the material surface is increased by thermal diffusion through, for example, high temperature oxidization. Thus, the terminal increases easily in contact resistance, and does not easily keep electrical connecting reliability. Accordingly, the surface roughness of the material surface is specified as follows: the arithmetic average roughness Ra is 0.15 μm or more in one or more direction(s) along the surface, and the arithmetic average roughness Ra is 3.0 μm or less, more desirably 0.2 to 2.0 μm in all directions along the surface. In the present invention, the arithmetic average roughness Ra is made maximum in the direction perpendicular to the rolled direction of the material surface.

(5) Area Ratio of Exposed Surface of Cu—Sn Alloy Coating Layer from Material Surface In the present invention, the area ratio of the exposed surface of the Cu—Sn alloy coating layer to the material surface (specifically, the surface of the Sn coating layer) is calculated as a value obtained by multiplying the exposed surface area of the Cu—Sn alloy coating layer per unit surface area of the material by 100. If the area ratio of the exposed surface of the Cu—Sn alloy coating layer to the material surface is less than 3%, in the fitting or separation of the terminals, the quantity of cohesion between their Sn coating layers increases and further the contacting area therebetween increases to make it difficult to lower frictional coefficient of the terminals. Thus, the terminals are also lowered in fretting corrosion resistance. On the other hand, if the area ratio of the exposed surface to the material surface is more than 75%, the amount of a Cu oxide and others is increased on the material surface, for example, with the passage of time or by corrosion. Thus, each of the terminals is easily increased in contact resistance, and does not easily keep electrical connecting reliability. Accordingly, the area ratio of the exposed surface of the Cu—Sn alloy coating layer to the material surface is specified to 3 to 75%, more desirably 10 to 50%.

(6) Average Material Surface Exposed Region Interval of Cu—Sn Alloy Coating Layer In the present invention, the average material surface exposed region interval of the Cu—Sn alloy coating layer is defined as a value obtained by adding the average of the respective widths of regions of the Cu—Sn alloy coating layer which traverse a straight line drawn on the material surface, namely the surface of the Sn coating layer (the widths: the respective lengths along the line) to that of the respective widths of regions of the Sn coating layer which traverse the line. If the average material surface exposed region interval of the Cu—Sn alloy coating layer is less than 0.01 mm, the amount of a Cu oxide is increased on the material surface by thermal diffusion through, for example, high temperature oxidization. Thus, the terminal increases easily in contact resistance, and does not easily keep electrical_connecting reliability. On the other hand, if the average material surface exposed region interval is more than 0.5 mm, the material used, in particular, in a small sized terminal may make it difficult to give a low frictional coefficient. In general, as terminals become smaller, the contact area between their electric contact point regions (fitted or separated regions), such as indents or ribs, becomes smaller. Thus, in the fitting or separation thereof, the probability of the contact between their Sn coating layers is increased. This increases the cohesion quantity so that the terminals do not easily obtain a low frictional coefficient. Accordingly, the average material surface exposed region interval of the Cu—Sn alloy coating layer is desirably set to 0.01 to 0.5 mm in the one or more direction(s) (particularly, the direction perpendicular to the rolled direction). More desirably, the average material surface exposed region interval of the Cu—Sn alloy coating layer is set to 0.01 to 0.5 mm in all the directions. This manner decreases the probability that in the fitting or separation of the terminals, only their Sn coating layers contact each other. Even more desirably, this interval is set to 0.05 to 0.3 mm in all the directions.

(7) Thickness of Regions of Cu—Sn Alloy Coating Layer Exposed from Outside Surface of Sn Coating Layer When the Cu—Sn alloy coating layer is partially exposed from the outside surface of the Sn coating layer as in the present invention, the thickness of regions of the Cu—Sn alloy coating layer that are exposed from the outside surface of the Sn coating layer may be far smaller than the average thickness of the Cu—Sn alloy coating layer in accordance with conditions for the production. In the present invention, the thickness of the regions of the Cu—Sn alloy coating layer exposed from the outside surface of the Sn coating layer is defined as a value measured through observation of a cross section of the layer (this measuring method is different from the method for measuring the average thickness of the Cu—Sn alloy coating layer). If the thickness of regions of the Cu—Sn alloy coating layer that are exposed from the outside surface of the Sn coating layer is less than 0.2 μm, the amount of a Cu oxide is increased on the material surface by thermal diffusion through, for example, high temperature oxidization and further the material deteriorates in corrosion resistance, in particular, when the Cu—Sn alloy coating layer is formed to be partially exposed from the material surface as in the present invention. Thus, the terminal easily increases in contact resistance, and does not easily keep electrical connecting reliability. Accordingly, the thickness of regions of the Cu—Sn alloy coating layer that are exposed from the outside surface of the Sn coating layer is desirably set to 0.2 μm or more, more desirably 0.3 μm or more.

(8) Average Thickness of Cu Coating Layer

In the case of using, as the base member, a Zn-containing Cu alloy such as brass or red brass, or other cases, the present electroconductive material may have a Cu coating layer between the base member and the Cu—Sn alloy coating layer. This Cu coating layer is a layer obtained by a matter that a Cu plating layer after subjected to reflow treatment remains. It is widely known that the Cu coating layer functions to restrain the diffusion of Zn and other base member constituent elements to the material surface, thus improving the material in solderability and others. If the Cu coating layer is too thick, the material deteriorates in shaping processability and also in economical efficiency. Thus, the thickness of the Cu coating layer is preferably 3.0 μm or less.

A small amount of component elements contained in the base member, and other elements may be incorporated in the Cu coating layer. When the Cu coating layer is made of a Cu alloy, examples of a constituent component other than Cu in the Cu alloy include Sn and Zn. Desirably, the content of Sn is less than 50% by mass, and that of other elements is less than 5% by mass.

(9) Average Thickness of Ni Coating Layer

The electroconductive material may have a Ni coating layer between the base member and the Cu—Sn alloy coating layer (in the case of having no Cu coating layer), or between the base member and the Cu coating layer. It is known that the Ni coating layer restrains the diffusion of Cu and other base member constituent elements to the material surface to restrain the terminal from being increased in contact resistance even after a long-term use at high temperature, restrains the growth of the Cu—Sn alloy coating layer to prevent the consumption of the Sn coating layer, and further improves the material in sulfurous acid gas corrosion resistance. The diffusion of the Ni coating layer itself to the material surface is restrained by the Cu—Sn alloy coating layer or the Cu coating layer. For this reason, a material for a connection component in which the Ni coating layer is formed is particularly suitable for a connection component for which heat resistance is required. If the Ni coating layer becomes too thick, the material deteriorates in shaping processability and others, and also in economical efficiency. Thus, the thickness of the Ni coating layer is preferably 3.0 μm or less.

A small amount of component elements contained in the base member, and other elements may be incorporated in the Ni coating layer. When the Ni coating layer is made of a Ni alloy, examples of a constituent component other than Ni in the Ni alloy include Cu, P, and Co. Desirably, the content of Cu is 40% or less by mass, and that of P or Co is 10% or less by mass.

Figure 2:
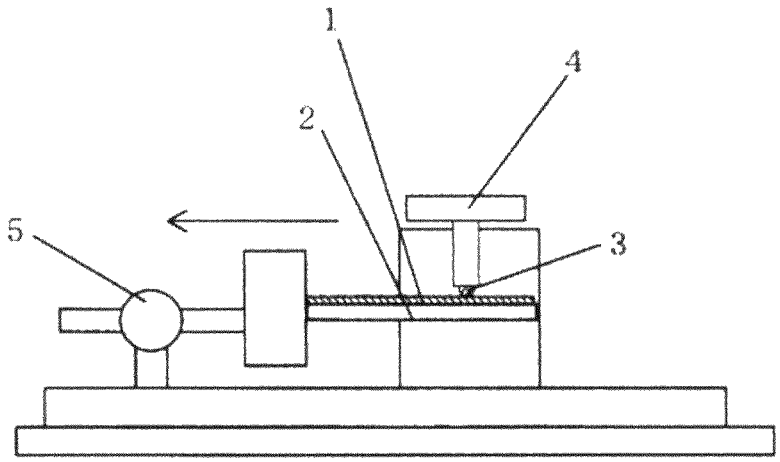
FIG. 2 is a conceptual view of a frictional coefficient measuring machine.
Figure 3:
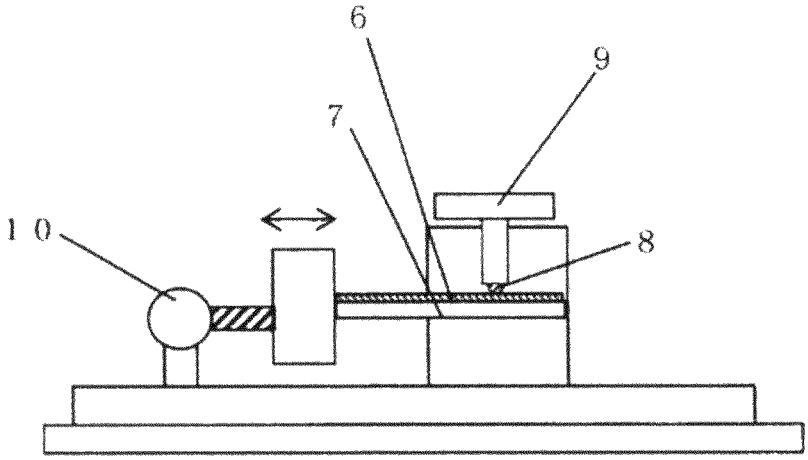
FIG. 3 is a conceptual view of a contact resistance measuring machine in fretting corrosion.

(10) Form of Regions of Cu—Sn Alloy Coating Layer Exposed from Outside Surface of Sn Coating Layer In the case of using, for example, buff polishing as a mean for roughening the surface of the copper alloy base member, the form of the regions of the Cu—Sn alloy coating layer that are exposed from the outside surface of the Sn coating layer is made to have streak microstructures extending lengthily along the polishing direction (usually, the rolled direction), as illustrated in, for example, FIG. 2 in Japanese Patent No. 4024244. On the other hand, in the case of using a working roll having a surface roughened by, for example, shot blast as a mean for roughening the surface of the copper alloy base member, the form is made to have random microstructures in which regions of the Cu—Sn alloy coating layer are distributed irregularly between portions of the Sn coating layer, as illustrated in FIG. 3 in Japanese Patent No. 4024244, or to have mixed microstructures composed of such random microstructures and streak microstructures extending along the rolled direction, as illustrated in FIG. 9 in Japanese Patent No. 4771970. It has been understood that when the form of the regions of the Cu—Sn alloy coating layer exposed from the outside surface of the Sn coating layer has the random microstructures or the mixed microstructures, any material having this form is somewhat smaller in frictional coefficient than that when the form of the regions of the Cu—Sn alloy coating layer exposed from the outside surface of the Sn coating layer has only streak microstructures extending lengthily in each of the directions perpendicular to and parallel to the rolled direction.

On the other hand, a difference in frictional coefficient has not been hitherto found out between the random microstructures and the mixed microstructures. The present inventors have however found out that when in the mixed microstructures the streak microstructures are formed in a density (the number per $mm^2$) of a predetermined value or more, frictional coefficient of the material is further deceased.

In the electroconductive material for a connection component according to the invention, the regions of the Cu—Sn alloy coating layer exposed from the outside surface of the Sn coating layer have random microstructures and streak microstructures; and out of these streak microstructures, streak microstructures extending in parallel to the rolled direction and having a length of 50 μm or more and a width of 10 μm or less are contained in a number of 35 or more per $mm^2$. In the electroconductive material for a connection component according to the invention, the density (the number per $mm^2$) of these streak microstructures, which have a length of 50 μm or more and a width of 10 μm or less, characterizes the form of the regions of the Cu—Sn alloy coating layer exposed from the outside surface of the Sn coating layer. If this density of the streak microstructures is less than 35 in an electroconductive material, this material produces a smaller effect of decreasing the respective frictional coefficients in the directions perpendicular and parallel to the rolled direction than the electroconductive material for a connection component in Japanese Patent No. 4024244.

The following will describe a method for producing the electroconductive material for a connection component according to the present invention.

(1) The electroconductive material for a connection component according to the invention may be basically produced by the production method described in Japanese Patent No. 4024244.

Specifically, a surface of a base member made of a copper alloy plate is first roughened to adjust the surface roughness to have an arithmetic average roughness Ra of 0.3 μm or more in one or more direction(s) along the surface, and an arithmetic average roughness Ra of 4.0 μm or less in all directions along the surface. The base member surface desirably has such a surface roughness that its asperities have an average interval Sm of 0.01 to 0.5 mm in the one or more direction(s). In the roughening of the base member surface, a working roll having a surface roughened by, for example, shot blast, is used to roll the base member, and then the base member is further mechanically polished (with, for example, a buff or brush) in the direction parallel to the rolled direction, or conversely the base member is mechanically polished in the direction parallel to the rolled direction, and then the working roll having a surface roughened by, for example, shot blast, is used to roll the base member. Alternatively, the base member surface may be roughened only by rolling the surface, using a working roll having a roughened surface. In this case, it is desired to use a working roll obtained by using, for example, a somewhat rough buff or brush to polish a rolling roll in the circumferential direction thereof (to form polish-irregularities in the rolling roll in the circumferential direction), and subsequently roughening the roll surface by shot blast; or use a working roll obtained by roughening the surface of a rolling roll by shot blast, and further polishing the surface in the circumferential direction with a brush or buff. According to such a surface roughening method, the arithmetic average roughness Ra of the base member surface can be made maximum in the direction perpendicular to the rolled direction.

When a working roll is used to roughen the base member surface by rolling, plural rolling (pass) operations through the same roll may not give appropriate asperities since asperities transferred to the base member by the first rolling operation interfere with asperities transferred to the base member by the second and subsequent rolling operations. It is therefore desired to transfer asperities to the base member by a single rolling operation. Accordingly, when a large rolling processability ratio is desired to require plural rolling passes, it is desired to conduct the final pass thereof through a working roll having a roughened surface. In order to transfer the asperities in the roll to the base member, it is desired that the rolling reduction according to the rolling pass for forming asperities is larger. The rolling reduction is desirably 10% or more, more desirably 15% or more, even more preferably 20% or more.

(2) Subsequently, a Sn plating layer is formed on the roughened surface of the base member, or a Cu plating layer and a Sn plating layer are formed in this order over the surface. Thereafter, the workpiece is subjected to reflow treatment to form a Cu—Sn alloy coating layer and a Sn coating layer in this order.

When only the Sn coating layer is formed on the base member surface, the Cu—Sn alloy coating layer is made of the Cu alloy base member and the Sn plating layer. When the Cu plating layer and the Sn plating layer are formed over the base member surface, the Cu—Sn alloy coating layer is composed of the Cu plating layer and the Sn plating layer. When the Cu plating layer is formed, a Ni plating layer may be formed between the base member and the Cu plating layer. The Cu plating layer remaining also after the reflow treatment is a Cu coating layer.

(3) If the arithmetic average roughness Ra of the roughened surface of the base member is less than 0.3 μm in all directions along the base member surface, it is very difficult to produce the electroconductive material for a connection component of the present invention. Specifically, it is very difficult to set the arithmetic average roughness Ra of the material surface after the reflow treatment to 0.15 μm or more in the one or more direction(s), and further set the area ratio of the exposed surface of the Cu—Sn alloy coating layer to the material surface to 3 to 75% while the average thickness of the Sn coating layer is adjusted to 0.2 to 5.0 μm. On the other hand, if the arithmetic average roughness Ra is more than 4.0 μm in any of all the directions, it is difficult to smooth the outside surface of the Sn coating layer by a flowing effect of Sn or the Sn alloy in a melted state. Accordingly, the surface roughness of the base member is adjusted to set the arithmetic average roughness Ra to 0.3 μm or more in the one or more direction(s) and set the arithmetic average roughness Ra to 4.0 μm or less in all the directions. This surface roughness produces a flowing effect of the melted Sn or Sn alloy (the smoothing of the Sn coating layer); following this effect, the Cu—Sn alloy coating layer that has been grown by the reflow treatment is partially exposed from the material surface.

The surface roughness of the base member is adjusted to set the arithmetic average roughness Ra to 0.4 μm or more in the one or more direction(s) and set the arithmetic average roughness Ra to 3.0 μm or less in all the directions.

(4) The above production method is a method of roughening a surface of a base member made of a copper alloy plate, applying a Sn plating layer directly or across a Ni plating layer or Cu plating layer onto the base member surface, and subsequently subjecting the workpiece to reflow treatment. It is desired that the material surface after the reflow treatment has an average material surface exposed region interval of 0.01 to 0.5 mm in the one or more direction(s) (particularly, the direction perpendicular to the rolled direction). The Cu—Sn alloy coating layer formed between the Cu alloy base member or the Cu plating layer, and the Sn plating in a melted state usually grows while reflecting the surface state of the base member. Thus, the material surface exposed region interval of the Cu—Sn alloy coating layer roughly reflects the average interval Sm between the asperities in the base member surface. Accordingly, the average interval Sm between the asperities, which is calculated out in the one or more direction(s), is desirably 0.01 to 0.5 mm, more desirably 0.05 to 0.3 mm. This manner makes it possible to control the exposure form of the regions of the Cu—Sn alloy coating layer exposed from the material surface.

(5) When the reflow treatment is conduced, reflow conditions are as follows: the temperature is from the melting temperature of the Sn plating layer to 600° C.; and the period is 3 to 30 seconds. In the case of Sn metal, the metal is not melted at a heating temperature lower than 230° C. In order to give a Cu—Sn alloy coating layer in which the Cu content is not too low, the temperature is desirably 240° C. or higher. If the temperature is higher than 600° C., the base member is softened to be strained and further to give a Cu—Sn alloy coating layer in which the Cu content is too high. Thus the resultant terminal cannot keep low contact resistance. If the heating time is shorter than 3 seconds, heat unevenly conducts the workpiece so that the Cu—Sn alloy coating layer cannot be formed with a sufficient thickness. If the time is longer than 30 seconds, the oxidization of the material surface advances. Thus, the resultant terminal increases in contact resistance to deteriorate also in fretting corrosion resistance.

By conducting this reflow treatment, the Cu—Sn alloy coating layer is formed and the melted Sn or Sn alloy flows to smooth the Sn coating layer so that the Cu—Sn alloy coating layer is exposed with a thickness of 0.2 μm or more to the material surface. Moreover, the plating particles become large so that the plating stress is declined, thus generating no whisker. In any case, in order to grow the Cu—Sn alloy coating layer evenly, it is desired to conduct the heat treatment at 300° C. or lower that is a temperature giving a calorie as small as possible and at a temperature at which Sn or the Sn alloy is melted.

Examples

Ingots of a copper alloy (brass) having a thickness of 45 mm and made of 30% by mass of Zn, and the balance made of Cu were soaked at 850° C. for 3 hours, and then hot-rolled to produce plates each having a thickness of 15 mm. The plates were quenched at 600° C. or higher, and subjected to cold rough rolling, recrystallization annealing, and finish cold rolling. In the finish cold rolling, the plates were subjected to surface roughening treatment or no surface roughening treatment to be finished into Cu alloy base members having a plate thickness of 0.25 mm and individual surface roughnesses. Furthermore, these members were annealed at low temperature, and then plated with Ni, Cu and Sn to give respective plating thicknesses. These workpieces were then subjected to reflow treatment at 280° C. for 10 seconds to obtain test materials Nos. 1 to 8 shown in Table 1. In the surface roughening treatment, about the test materials Nos. 1, 5 and 6, a working roll having a surface roughened by brush polishing and shot blast was used to roll the respective materials to be reduced in volume. About the test materials Nos. 2 to 4, a working roll having a surface roughened by shot blast was use to roll the respective materials to be reduced in volume. Subsequently, these workpieces were polished with a buff along the rolled direction. About the test materials Nos. 7 and 8, no surface roughening treatment was conducted.

According to the methods described below, the test materials Nos. 1 to 8 were measured about the surface roughness of their Cu alloy base member, and the respective average thicknesses of their Ni plating, their Cu plating, and their Sn plating. The results are shown in Table 1.

[Measurement of Average Thickness of Ni Plating]

A fluorescent X-ray film thickness meter (SFT3200, manufactured by Seiko Instruments Ltd.) was used to calculate out the average thickness of the Ni plating of each of the test materials before the reflow treatment. The measuring conditions were as follows: a calibration curve used therein was a 2-layer calibration curve of a Sn/Ni/base member, and the collimator diameter was set to 0.5 mm. The average thickness of the Ni plating layer is hardly changed before and after the reflow treatment.

[Measurement of Average Thickness of Cu Plating]

A cross section of each of the test materials processed by a microtome method before the reflow treatment was observed through an SEM (scanning electron microscope) at 10,000 magnifications. The cross section image was subjected to image processing to calculate out the average thickness of the Cu plating.

[Measurement of Average Thickness of Sn Plating]

A fluorescent X-ray film thickness meter (SFT3200, manufactured by Seiko Instruments Ltd.) was used to calculate out the average thickness of the Sn plating of each of the test materials before the reflow treatment. The measuring conditions were as follows: a calibration curve used therein was a single-layer calibration curve of a Sn/base member, or a 2-layer calibration curve of a Sn/Ni/base member, and the collimator diameter was set to 0.5 mm.

Respective surface coating layer structures and material surface roughnesses of the resultant test materials Nos. 1 to 8 are together shown in Table 1. According to the methods described below, the following were measured: the Cu content in their Cu—Sn coating layer; the average thickness of the Cu—Sn alloy coating layer; the average thickness of their Sn coating layer; the area ratio of the exposed surface of the Cu—Sn alloy coating layer to their material surface; the average material surface exposed region interval of the Cu—Sn alloy coating layer; the density of streak microstructures of regions of the Cu—Sn alloy coating layer exposed from the material surface; the thickness of the regions of the Cu—Sn alloy coating layer exposed from the material surface; and the material surface roughness.

TABLE 1

| | | Average thickness of plating layer (μm) | | | Average thickness of surface coating layer (μm) | | | | | | | | |
|---|---|---|---|---|---|---|---|---|---|---|---|---|---|
| | | | | | Cu—Sn | | | Cu content | | Surface ratio | Density of | Base member roughness | |
| | | Ni | Cu | Sn | Ni | alloy | Sn | (%) in | Surface | of exposed | streak | | |
| No. | | plating layer | plating layer | plating layer | coating layer | coating layer | coating layer | Cu—Sn alloy | roughness Ra (μm) | Cu—Sn alloy (%) | Cu—Sn alloy (number/mm$^2$) | Ra (μm) | Sm (mm) |
| Invention | 1 | 0.3 | 0.15 | 0.6 | 0.3 | 0.35 | 0.3 | 60 | 0.37 | 40 | 35 | 0.45 | 0.07 |
| Examples | 2 | — | 0.2 | 2.3 | — | 0.55 | 2.0 | 55 | 1.25 | 50 | 50 | 2.80 | 0.25 |
| | 3 | — | 0.2 | 0.8 | — | 0.60 | 0.4 | 45 | 0.40 | 60 | 40 | 0.60 | 0.09 |
| | 4 | 0.3 | 0.2 | 0.9 | 0.3 | 0.50 | 0.5 | 50 | 0.57 | 50 | 80 | 0.72 | 0.15 |
| Comparative | 5 | 0.3 | 0.15 | 0.8 | 0.3 | 0.45 | 0.5 | 55 | 0.34 | 28 | 20 | 0.43 | 0.08 |
| Examples | 6 | — | 0.2 | 0.9 | — | 0.45 | 0.6 | 58 | 0.44 | 50 | 5 | 0.68 | 0.14 |
| | 7 | 0.3 | 0.15 | 0.7 | 0.3 | 0.50 | 0.4 | 55 | 0.07 | 0 | 0 | 0.11 | 0.06 |
| | 8 | — | 0.15 | 1.0 | — | 0.45 | 0.5 | 55 | 0.05 | 0 | 0 | 0.09 | 0.04 |

[Measurements of Surface Roughness of Cu Alloy Base Member]

A contact-type surface roughness meter (SURFCOM 1400, manufactured by Tokyo Seimitsu Co., Ltd.) was used to measure the roughness on the basis of JIS B0601-1994. Conditions for the surface roughness measurement were as follows: the cutoff value was set to 0.8 mm; the standard length was 0.8 mm; the evaluating length was 4.0 mm; the measuring rate was 0.3 mm/s; and the radius of the probe tip was 5 μmR.

[Measurement of Cu Content in Cu—Sn Alloy Coating Layer]

Each of the test materials was first immersed in an aqueous solution containing p-nitrophenol and sodium hydroxide as components for 10 minutes to remove the Sn layer. Thereafter, an EDX (energy dispersive X-ray spectrometer) was used to analyze the Cu content in the Cu—Sn alloy coating layer quantitatively.

[Measurement of Average Thickness of Cu—Sn Alloy Coating Layer]

Each of the test materials was first immersed in an aqueous solution containing p-nitrophenol and sodium hydroxide as components for 10 minutes to remove the Sn layer. Thereafter, a fluorescent X-ray film thickness meter (SFT3200, manufactured by Seiko Instruments Ltd.) was used to measure the film thickness of the Sn component contained in the Cu—Sn alloy coating layer. The measuring conditions were as follows: a calibration curve used therein was a single-layer calibration curve of a Sn/base member, or a 2-layer calibration curve of a Sn/Ni/base member, and the collimator diameter was set to 0.5 mm. The resultant value was defined as the average thickness of the Cu—Sn alloy coating layer.

[Measurement of Average Thickness of Sn Coating Layer]

A fluorescent X-ray film thickness meter (SFT3200, manufactured by Seiko Instruments Ltd.) was first used to measure the sum of the film thickness of the Sn coating layer of each of the test materials and that of the Sn component contained in the Cu—Sn alloy coating layer. Thereafter, the test material was immersed in an aqueous solution containing p-nitrophenol and sodium hydroxide as components for 10 minutes to remove the Sn layer. The fluorescent X-ray film thickness meter was again used to measure the film thickness of the Sn component contained in the Cu—Sn alloy coating layer. The measuring conditions were as follows: a calibration curve used therein was a single-layer calibration curve of a Sn/base member, or a 2-layer calibration curve of a Sn/Ni/base member, and the collimator diameter was set to 0.5 mm. The average thickness of the Sn coating layer was calculated out by subtracting the film thickness of the Sn component contained in the Cu—Sn alloy coating layer from the resultant sum of the film thickness of the Sn coating layer and that of the Sn component contained in the Cu—Sn alloy coating layer.

[Area Ratio of Exposed Surface of Cu—Sn Alloy Coating Layer to Material Surface]

An SEM (scanning electron microscope), on which an EDX (energy dispersive X-ray spectrometer) was mounted, was used to observe the surface of each of the test materials at 200 magnifications. From a difference in the brightness of the resultant composition image (from which a difference according to contrasts based on stains, scratches and the like was removed), the area ratio of the exposed surface of the Cu—Sn alloy coating layer to the material surface was measured by image analysis. FIG. 1 shows an SEM composition image of the test material No. 3.

[Average Material Surface Exposed Region Interval of Cu—Sn Alloy Coating Layer]

An SEM (scanning electron microscope), on which an EDX (energy dispersive X-ray spectrometer) was mounted, was used to observe the surface of each of the test materials at 200 magnifications. From the resultant composition image, an average was calculated as a value obtained by adding the average of the respective widths of the Cu—Sn alloy coating layer regions traversing a straight line drawn on the material surface and along the direction perpendicular to the rolled direction (the widths: the respective lengths along the line) to that of the respective widths of the Sn coating layer regions traversing the line. In this way, the average material surface exposed region interval of the Cu—Sn alloy coating layer was measured.

[Measurement of Density of Streak Microstructures of Regions of Cu—Sn Alloy Coating Layer Exposed from Material Surface]

An SEM (scanning electron microscope), on which an EDX (energy dispersive X-ray spectrometer) was mounted, was used to observe the surface of each of the test materials at 200 magnifications. In the Cu—Sn alloy coating layer viewed in an area of 1 $mm^2$ of the resultant composition image, the number of streak microstructures having a length of 50 μm or more in the direction parallel to the rolled direction and a width of 10 μM or less was counted. The SEM composition image of the test material No. 3 is shown in FIG. 1. A whitely viewed region therein is the Sn coating layer of the outmost surface, and blackly viewed regions are the regions of the Cu—Sn alloy coating layer exposed from the material surface. The Cu—Sn alloy coating layer was composed of random microstructures dispersed discontinuously between portions of the white Sn coating layer region, and streak microstructures extending along the rolled direction.

[Measurement of Thickness of Regions of Cu—Sn Alloy Coating Layer Exposed from Material Surface]

A cross section of each of the test materials processed by a microtome method was observed through an SEM (scanning electron microscope) at 10,000 magnifications. The cross section image was subjected to image processing to calculate out the average thickness of the Cu—Sn alloy coating layer regions exposed from the material surface.

[Measurement of Surface Roughness of Material]

A contact-type surface roughness meter (SURFCOM 1400, manufactured by Tokyo Seimitsu Co., Ltd.) was used to measure the roughness on the basis of JIS B0601-1994. Conditions for the surface roughness measurement were as follows: the cutoff value was set to 0.8 mm; the standard length was 0.8 mm; the evaluating length was 4.0 mm; the measuring rate was 0.3 mm/s; and the radius of the probe tip was 5 μmR. The direction in which the surface roughness was measured was rendered a direction perpendicular to the rolled direction (i.e., a direction in which the largest surface roughness was to be exhibited).

According to the methods described below, the resultant test materials were subjected to a frictional coefficient evaluating test, a contact resistance evaluating test after heating, and a contact resistance evaluating test when minutely slid. The results are shown in Table 2.

TABLE 2

| | | Frictional coefficient | | Contact | Contact resistance (mΩ) |
|---|---|---|---|---|---|
| | No. | Perpendicular to rolling direction | Parallel to rolling direction | resistance (mΩ) after heating | in fretting corrosion test |
| Invention Examples | 1 | 0.24 | 0.26 | 0.3 | 5 |
| | 2 | 0.21 | 0.24 | 0.7 | 3 |
| | 3 | 0.23 | 0.24 | 0.9 | 4 |
| | 4 | 0.20 | 0.24 | 0.3 | 2 |
| Comparative Examples | 5 | 0.26 | 0.28 | 0.4 | 8 |
| | 6 | 0.27 | 0.27 | 1.1 | 6 |
| | 7 | 0.41 | 0.40 | 0.3 | 10 |
| | 8 | 0.56 | 0.57 | 1.0 | 20 |

[Test for Evaluating Frictional Coefficient]

The shape of an indent region of electrical contact points of fittable-type connectors was imitated, and the frictional coefficient thereof was evaluated, using a machine as illustrated in FIG. 2. First, a plate-form male test piece cut out from each of the test materials (Nos. 1 to 8) was fixed onto a horizontal stand 2. A female test piece 3 was put thereon, the piece 3 being a member cut out from the test material No. 8 and processed into a semi-spherical form (inside diameter: 1.5 mm), in the state of bringing their coating layers into contact with each other. Subsequently, a load of 3.0 N (weight 4) was applied onto the female test piece 3 to push the male test piece 1. A lateral-type load measuring machine (Model-2152, manufactured by Aikoh Engineering Co., Ltd.) was used to pull out the male test piece 1 in a horizontal direction (sliding speed: 80 mm/minute). During a period to a time when the sliding distance reached 5 mm, the maximum frictional force F (unit: N) was measured. The sliding direction of the male test piece 1 was rendered respective directions perpendicular and parallel to the rolled direction. The frictional coefficient was calculated out in accordance with the equation (1) described below. In FIG. 2, reference 5 shows a load cell, and an arrow shows the sliding direction.

$$\text{Frictional coefficient}=F/3.0 \quad (1)$$

[Test for Evaluating the Respective Contact Resistances after Held at High Temperature for Extended Period of Time]

Each of the test materials was subjected to thermal treatment in the atmosphere at 160° C. for 120 hours, and then the contact resistance thereof was measured by the four-terminal method under conditions that the open voltage was 20 mV and the current was 10 mA without sliding the material.

[Test for Evaluating Contact Resistance in Fretting Corrosion]

The shape of an indent region of electrical contact points of fittable-type connectors was imitated, and the frictional coefficient thereof was evaluated, using a sliding test machine (CRS-B1050CHO, manufactured by Yamasaki-Seiki Co., Ltd.) as illustrated in FIG. 3. First, a plate-form male test piece 6 cut out from the test material No. 8 was fixed onto a horizontal stand 7. A female test piece 8 was put thereon, the piece 8 being a member cut out from each of the test materials (Nos. 1 to 8) and processed into a semi-spherical form (inside diameter: 1.5 mm), in the state of bringing their coating layers into contact with each other. Subsequently, a load of 2.0 N (weight 9) was applied onto the female test piece 8 to push the male test piece 6. A constant current was applied to between the male test piece 6 and the female test piece 8 to slide the male test piece 6 in a horizontal direction (sliding distance: 50 μm, and the sliding frequency: 1 Hz), using a stepping motor 10. During a period to a time when the number of times of the sliding reached 1000, the maximum contact resistance was measured by the four-terminal method under conditions that the open voltage was 20 mV and the current was 10 mA. The sliding direction of the male test piece 6 was rendered a direction perpendicular to the rolled direction. In FIG. 3, arrows represent the sliding directions.

As shown in Table 2, the materials Nos. 1 to 4 satisfy all the requirements specified in the present invention about their surface coating layer structures, thus having low frictional coefficient and having particularly low frictional coefficient in the direction perpendicular to the rolled direction. These materials are also excellent in contact resistance after left at high temperature for a long term, and contact resistance in fretting corrosion.

On the other hand, the materials Nos. 5 and 6, which correspond to respective electroconductive materials for a connection component described in Japanese Patent No. 4024244 and Japanese Patent No. 4771970, do not satisfy only the requirement about the density of the streak microstructures of the Cu—Sn alloy coating layer regions exposed from their material surface, out of the requirements specified in the present invention. Thus, the materials has higher frictional coefficient and contact resistance in fretting corrosion than the materials Nos. 1 to 4. The materials Nos. 5 and 6, which underwent the surface roughening treatment by the rolling using a working roll whose surface was roughed by brush polishing and sand blast, were small in rolling reduction, and also were small in size of the polish-irregularities made by the brush polishing. Thus, the Cu—Sn alloy coating layer regions exposed from their material surface were small in density of the streak microstructure. Thus, the frictional coefficient, and the contact resistance in fretting corrosion were not sufficiently improved.

The materials Nos. 7 and 8 using an ordinary base member without any surface-roughening treatment, which correspond to the electroconductive material for a connection component described in Japanese Patent No. 4090302, has higher frictional coefficient and contact resistance in fretting corrosion than those of Nos. 5 and 6 since their Cu—Sn alloy coating layer is not exposed from the material surface.

What is claimed is:

1. An electroconductive material, comprising:

a base member made of a copper alloy plate, a Cu—Sn alloy coating layer formed on the base member and having a Cu content of 20 to 70% by atom and an average thickness of 0.2 to 3.0 μm, and a Sn coating layer formed on the Cu—Sn alloy coating layer and having an average thickness of 0.2 to 5.0 μm, wherein a surface of the material, which is an outside surface of the Sn coating layer, is subjected to reflow treatment and has an arithmetic average roughness Ra of 0.15 μm or more in at least one direction along the surface and an arithmetic average roughness Ra of 3.0 μm or less in all directions along the surface, the Cu—Sn alloy coating layer has an exposed surface which is partially exposed from the outside surface of the Sn coating layer, an area ratio of the exposed surface of the Cu—Sn alloy coating layer to the surface of the material is 3 to 75%, the Cu—Sn alloy coating layer has an average material surface exposed region interval of 0.01 to 0.5 mm in at least one direction along the surface, regions of the exposed surface of the Cu—Sn alloy coating layer have random microstructures distributed irregularly between portions of the Sn coating layer and streak microstructures extending in parallel to a rolled direction of the base member, the surface of the material has a number density of the streak microstructures having a length of 50 μm or more and a width of 10 μm or less of 35 or more per 1 $mm^2$, and a frictional coefficient in a direction perpendicular to the rolled direction is smaller than a frictional coefficient in a direction parallel to the rolled direction.

2. The electroconductive material according to claim 1, wherein a thickness of the exposed surface of the Cu—Sn alloy coating layer is 0.2 μm or more.

3. The electroconductive material according to claim 1, further comprising a Cu coating layer between the base member and the Cu—Sn alloy coating layer.

4. The electroconductive material according to of claim 1, further comprising a Ni coating layer between the base member and the Cu—Sn alloy coating layer.

5. The electroconductive material according to claim 4, further comprising a Cu coating layer between the Ni coating layer and the Cu—Sn alloy coating layer.

6. The electroconductive material according to claim 1, wherein an arithmetic average roughness Ra of a surface of the base member is 0.3 μm or more at least in one direction and 4.0 μm or less in all directions.

7. The electroconductive material according to claim 6, wherein the surface of the base member has asperities with an average interval Sm of 0.01 to 0.5 mm at least in one direction.

8. The electroconductive material according to claim 1, which is suitable for a connection component.

* * * * *